US008137014B2

(12) United States Patent
Wang et al.

(10) Patent No.: US 8,137,014 B2
(45) Date of Patent: Mar. 20, 2012

(54) DUPLEX PRINTING APPARATUS

(75) Inventors: Chung-Kai Wang, Taipei (TW); Chien-Kuo Kuan, Taipei (TW)

(73) Assignee: Primax Electronics Ltd., Taipei (TW)

( * ) Notice: Subject to any disclaimer, the term of this patent is extended or adjusted under 35 U.S.C. 154(b) by 961 days.

(21) Appl. No.: 12/131,324

(22) Filed: Jun. 2, 2008

(65) Prior Publication Data

US 2009/0220293 A1 Sep. 3, 2009

(30) Foreign Application Priority Data

Feb. 29, 2008 (TW) ..... 97106977 A

(51) Int. Cl.
*B41J 3/60* (2006.01)

(52) U.S. Cl. ..... 400/188

(58) Field of Classification Search ..... 400/188
See application file for complete search history.

(56) References Cited

U.S. PATENT DOCUMENTS 6,764,236 B2 * 7/2004 Suzuki ..... 400/642
7,344,238 B2 * 3/2008 Tanaka et al. ..... 347/104
7,682,096 B2 * 3/2010 Matsushima et al. ..... 400/693

* cited by examiner

*Primary Examiner* — Daniel Hess
*Assistant Examiner* — David Tardif
(74) *Attorney, Agent, or Firm* — Kirton McConkie; Evan R. Witt

(57) ABSTRACT

The present invention relates to a duplex printing apparatus. The duplex printing apparatus includes a paper input tray, a paper ejecting tray, a paper pick-up roller, a paper feeding channel, a first paper transfer roller assembly, a scanning and developing print unit, a print region, a paper ejecting channel, a second paper transfer roller assembly, an inverting channel, a paper guide slice, a third paper transfer roller assembly and a paper ejecting roller assembly. By arranging the inverting channel between the print region and the paper ejecting tray, the printing speed is enhanced.

5 Claims, 2 Drawing Sheets

DUPLEX PRINTING APPARATUS

FIELD OF THE INVENTION

The present invention relates to a duplex printing apparatus, and more particularly to a duplex printing apparatus for performing a duplex printing operation.

BACKGROUND OF THE INVENTION

With rapid development of electronic industries, a diversity of printing apparatuses such as copiers, printers, scanners or multifunction peripherals become essential information apparatuses in offices. Among these printing apparatuses, the printers are the most popular. In the early stage, a printer can perform a single-side printing operation. For performing duplex printing operations by such a printer, a first page of a document file shown on a computer screen is firstly printed on a first side of a blank paper. After the first page of a document file has been printed, the paper containing the printed image of the first page should be manually turned over and then placed on the paper input tray of the printer. Next, a second page of the document file is printed on a second side of the paper. However, the process of manually turning over the paper is troublesome. This drawback becomes more serious if the document contains a great number of pages. Recently, a duplex printing apparatus has been developed for automatically performing a duplex printing operation.

FIG. 1 is a schematic cross-sectional view illustrating inner components of a conventional duplex printing apparatus. As shown in FIG. 1, the conventional duplex printing apparatus 100 principally comprises a paper input tray 101, a paper ejecting tray 102, a paper pick-up roller 106, a paper feeding channel 105, a first paper transfer roller assembly 109, a scanning and developing print unit 103, a print region 104, a paper ejecting channel 107, a heating roller 1038, a pressing roller 1039, an inverting channel 108, a paper guide slice 113, a second paper transfer roller assembly 110, a third paper transfer roller assembly 111, a fourth paper transfer roller assembly 114 and a paper ejecting roller assembly 112. The scanning and developing print unit 103 is disposed in the print region 104. The scanning and developing print unit 103 includes a laser scanning unit 1031, an optical photoconductive drum 1032, a charging roller 1033, a developer roller 1034, a toner adding roller 1035, a transferring roller 1036 and a blade 1037. The blank papers (not shown) to be printed are placed on the paper input tray 101. The printed papers are supported on the paper ejecting tray 102. The paper feeding channel 105 is arranged between the paper input tray 101 and the print region 104. The first paper transfer roller assembly 109 is disposed in the paper feeding channel 105. The paper ejecting channel 107 is arranged between the print region 104 and the paper ejecting tray 102. The heating roller 1038, the pressing roller 1039 and the paper ejecting roller assembly 112 are disposed in the paper ejecting channel 107. The paper ejecting roller assembly 112 includes a paper ejecting driving roller 1121 and a paper ejecting follower roller 1122. The inverting channel 108 is extended from the paper ejecting tray 102 to the paper feeding channel 105, as can be seen in FIG. 1. The paper which is fed into the inverting channel 108 can be transported by the second paper transfer roller assembly 110, the third paper transfer roller assembly 111 and the fourth paper transfer roller assembly 114 into the print region 104 again.

Hereinafter, a procedure of performing a duplex printing operation by the conventional duplex printing apparatus 100 will be illustrated with reference to FIG. 1. First of all, the image of the first page of the document file is read and transmitted to the laser scanning unit 1031. Then, the charging roller 1033 uniformly charges the outer surface of the optical photoconductive drum 1032. After the charging procedure, the laser scanning unit 1031 linearly scans the image of the first page in a form of laser beams, thereby forming an electrostatic latent image of the first page on the optical photoconductive drum 1032. Next, the toner adding roller 1035 supplies the developer roller 1034 with toner from a toner cartridge (not shown) of the scanning and developing print unit 103. Then, the developer roller 1034 contacts with the optical photoconductive drum 1032 for supplying the electrostatic latent image on the optical photoconductive drum 1032 with toner. As a consequence, the electrostatic latent image formed on the optical photoconductive drum 1032 is rendered visible as a toner image. After the above image processing procedure in the scanning and developing print unit 103, the paper pick-up roller 106 transports a paper from the paper input tray 101 into the paper feeding channel 105. Next, the first paper transfer roller assembly 109 transports the paper into the print region 104. When the paper passes through the region between the optical photoconductive drum 1032 and the transferring roller 1036 of the print region 104, the paper is attracted onto the surface of the optical photoconductive drum 1032 and contact with the toner. Since the outer surface of the transferring roller 1036 and the toner are oppositely charged, the toner on the optical photoconductive drum 1032 will be adsorbed onto the first side of the paper. After the toner image is transferred to first side of the paper, the blade 1037 will remove the toner remaining on the optical photoconductive drum 1032 for reuse. Next, the paper with the toner image is transported into the paper ejecting channel 107. When the paper is transported across the region between the heating roller 1038 and the pressing roller 1039, the paper is heated and pressed by the heating roller 1038 and the pressing roller 1039 such that the toner is molten and penetrated into the space between fibers of the paper. Since the heating roller 1038 and the pressing roller 1039 can facilitate fusing the toner onto the paper, the heating roller 1038 and the pressing roller 1039 function as fusing units of the typical laser printing apparatus. After the printing operation on the first page of the document file is completed, the paper containing the printed first page is transported to the paper ejecting tray 102 by the paper ejecting roller assembly 112. Meanwhile, the paper guide slice 113, which is arranged at the junction between the paper ejecting channel 107 and the inverting channel 108, is switched to close the path leading to the inverting channel 108.

Until the tail edge of the paper is nipped between the paper ejecting driving roller 1121 and the paper ejecting follower roller 1122 of the paper ejecting roller assembly 112, the paper guide slice 113 is switched to close the path leading to the paper ejecting channel 107. Meanwhile, the paper ejecting driving roller 1121 is rotated in a reverse direction and cooperates with the paper ejecting follower roller 1122 to feed the paper into the inverting channel 108. After the paper is fed into the inverting channel 108, the paper is successively transported by the second paper transfer roller assembly 110, the third paper transfer roller assembly 111 and the fourth paper transfer roller assembly 114 into the paper feeding channel 105. Next, the first paper transfer roller assembly 109 transports the paper into the print region 104. At this moment, the image of the second page of the document file has been read and transmitted to the laser scanning unit 1031. During the paper is transported across the print region 104, developing and printing operations as described for the image of the first page are performed on the second side of the paper. After the toner image is transferred to second side of the paper, the paper with the toner image is exited from the print region 104 and fed into the paper ejecting channel 107. When the paper is transported across the region between the heating roller 1038 and the pressing roller 1039, the paper is heated and pressed by the heating roller 1038 and the pressing roller 1039, which function as fusing units. After the heating and pressing operation has done, the paper is transported to the paper ejecting tray 102 by the paper ejecting roller assembly 112 and thus the duplex printing operation is completed. Meanwhile, the paper guide slice 113 is switched to open the path leading to the paper ejecting channel 107.

Although the use of the conventional duplex printing apparatus becomes more convenient because it is not required to manually turn over the paper, there are still some drawbacks. For example, during the process of turning over the paper by the conventional duplex printing apparatus, the paper should be transported across the inverting channel and sent to the print region again. The arrangement of the inverting channel increases the length of the duplex printing apparatus. Therefore, the overall volume of the duplex printing apparatus is increased, which is detrimental to the space utilization. Moreover, since the inverting channel is relatively longer, it is time-consuming to print an image on the second side of the paper and the duplex printing operation has a reduced printing speed.

SUMMARY OF THE INVENTION

The present invention relates to a duplex printing apparatus, and more particularly to a duplex printing apparatus with an increased printing speed.

In accordance with an aspect of the present invention, there is provided a duplex printing apparatus for printing images on a first side and a second side of a paper. The duplex printing apparatus includes a paper input tray, a paper ejecting tray, a scanning and developing print unit, a paper feeding channel, a paper pick-up roller, a paper ejecting channel, an inverting channel, a first paper transfer roller assembly, a second paper transfer roller assembly, a third paper transfer roller assembly and a paper ejecting roller assembly.

The paper input tray is used for placing the paper thereon. The paper ejecting tray is disposed above the paper input tray for supporting the printed paper thereon. The scanning and developing print unit is disposed in a print region for reading the images and printing the images on the paper. The paper feeding channel is arranged between the paper input tray and the print region for leading the paper to the print region such that the images are printed on the first side of the paper when the paper is transported across the print region. The paper pick-up roller is disposed beside the paper input tray for transporting the paper into the paper feeding channel. The paper ejecting channel is arranged between the print region and the paper ejecting tray for leading the paper to the paper ejecting tray. The inverting channel is arranged between the print region and the paper ejecting tray for leading the paper to the print region again such that the images are printed on the second side of the paper when the paper is transported across the print region. The first paper transfer roller assembly is arranged at the junction between the paper feeding channel and the inverting channel for transporting the paper into the print region. The second paper transfer roller assembly is disposed in the paper ejecting channel for transporting the paper. The third paper transfer roller assembly is disposed in the inverting channel for transporting the paper to into the print region. The paper ejecting roller assembly is used for transporting the paper to either the paper ejecting tray or the inverting channel.

In an embodiment, the scanning and developing print unit includes a laser scanning unit, an optical photoconductive drum, a charging roller, a developer roller, a toner adding roller, a transferring roller and a blade.

In an embodiment, the second paper transfer roller assembly includes a heating roller and a pressing roller.

In an embodiment, the paper ejecting roller assembly includes a paper ejecting driving roller and a paper ejecting follower roller. The paper ejecting driving roller can be rotated in either a positive direction or a reverse direction.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
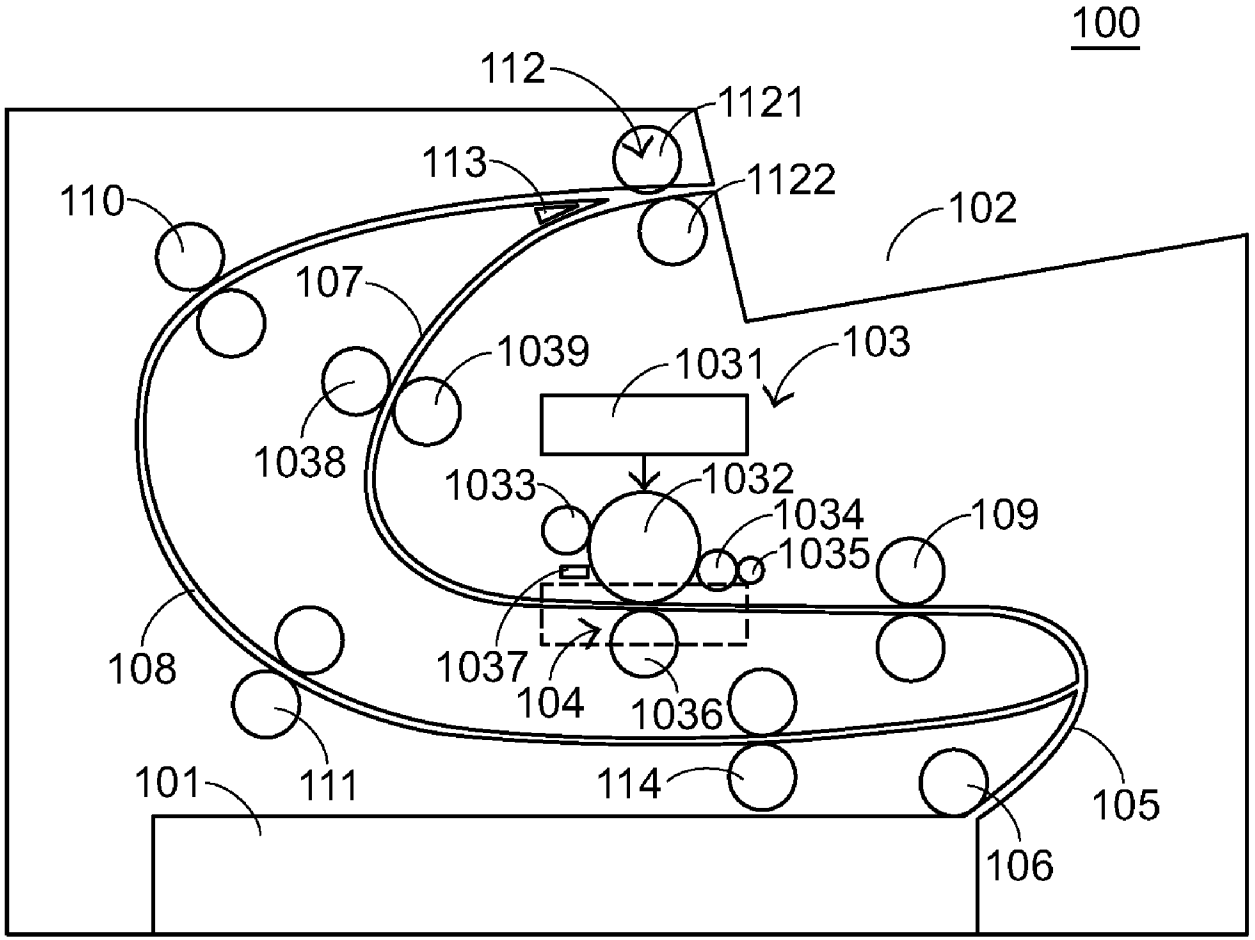
FIG.1 PRIOR ART
FIG. 1 is a schematic cross-sectional view illustrating inner components of a conventional duplex printing apparatus.
Figure 2:
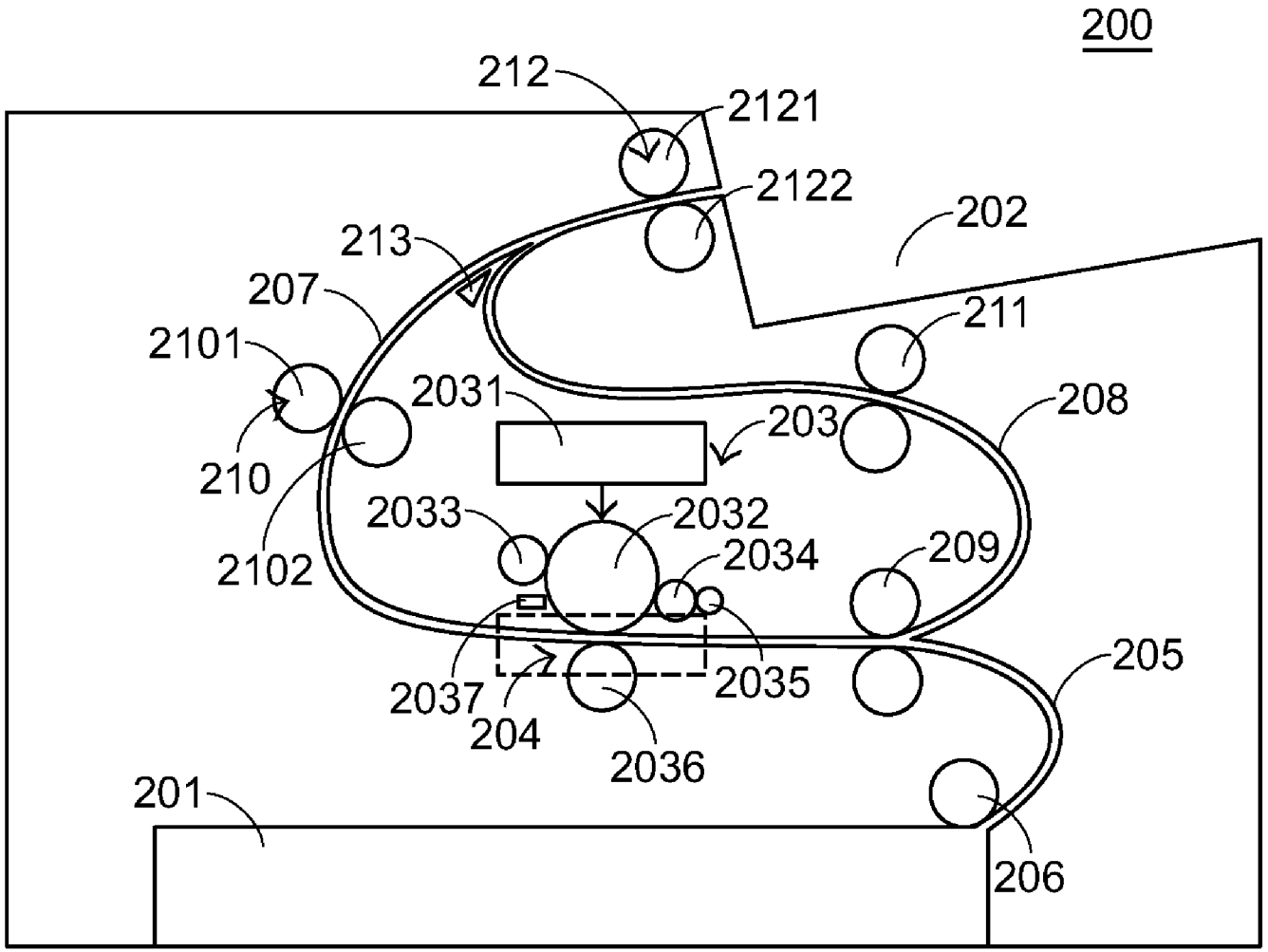
FIG. 2 is a schematic cross-sectional view illustrating inner components of a duplex printing apparatus according to a preferred embodiment of the present invention.

FIG. 2 is a schematic cross-sectional view illustrating inner components of a duplex printing apparatus according to a preferred embodiment of the present invention. As shown in FIG. 2, the duplex printing apparatus 200 principally comprises a paper input tray 201, a paper ejecting tray 202, a paper pick-up roller 206, a paper feeding channel 205, a first paper transfer roller assembly 209, a scanning and developing print unit 203, a print region 204, a paper ejecting channel 207, a second paper transfer roller assembly 210, an inverting channel 208, a paper guide slice 213, a third paper transfer roller assembly 211 and a paper ejecting roller assembly 212. The scanning and developing print unit 203 includes a laser scanning unit 2031, an optical photoconductive drum 2032, a charging roller 2033, a developer roller 2034, a toner adding roller 2035, a transferring roller 2036 and a blade 2037. The blank papers (not shown) to be printed are placed on the paper input tray 201. The paper ejecting tray 202 is disposed above the paper input tray 201 for supporting the printed papers thereon. The paper feeding channel 205 is arranged between the paper input tray 201 and the print region 204. The first paper transfer roller assembly 209 is disposed in the paper feeding channel 205. The paper ejecting channel 207 is arranged between the print region 204 and the paper ejecting tray 202. The second paper transfer roller assembly 210 and the paper ejecting roller assembly 212 are disposed in the paper ejecting channel 207. The paper ejecting roller assembly 212 includes a paper ejecting driving roller 2121 and a paper ejecting follower roller 2122.

The duplex printing apparatus 200 of the present invention is distinguished from the conventional duplex printing apparatus 100 in that the inverting channel 208 is arranged between the print region 204 and the paper ejecting tray 202 and the third paper transfer roller assembly 211 is disposed in the inverting channel 208. Moreover, since the heating and pressing function is imparted to the second paper transfer roller assembly 210, no additional heating roller and pressing roller are required. That is, in addition to the function of transporting papers, both roller 2101 and 2102 of the second paper transfer roller assembly 210 can function as a heating roller and a pressing roller, respectively. In addition, the paper guide slice 213 is arranged at the junction between the paper ejecting channel 207 and the inverting channel 208.

Hereinafter, a procedure of performing a duplex printing operation by the duplex printing apparatus 200 will be illustrated with reference to FIG. 2. First of all, the image of the first page of the document file is read and transmitted to the scanning and developing print unit 203. After the above image processing procedure in the scanning and developing print unit 203, the paper pick-up roller 206 transports a paper from the paper input tray 201 into the paper feeding channel 205. Next, the first paper transfer roller assembly 209 transports the paper into the print region 204. When the paper is transported across the scanning and developing print unit 203, the scanning and developing print unit 203 performs a printing operation on a first side of the paper such that the toner image of the first page of the document file is transferred to first side of the paper. The printing operation performed by the scanning and developing print unit 203 is identical to that described in the prior art, and is not redundantly illustrated herein. Next, the paper with the toner image is transported into the paper ejecting channel 207. When the paper is transported across the second paper transfer roller assembly 210, the paper is heated and pressed by the second paper transfer roller assembly 210. As a consequence, the toner is molten and penetrated into the space between fibers of the paper so as to facilitate fusing the toner onto the paper. At this moment, the paper guide slice 213 is switched to close the path leading to the inverting channel 208. After the printing operation on the first page of the document file is completed, the paper containing the printed first page is transported to the paper ejecting tray 202 by the paper ejecting roller assembly 212.

Until the tail edge of the paper is nipped between the paper ejecting driving roller 2121 and the paper ejecting follower roller 2122 of the paper ejecting roller assembly 212, the paper guide slice 213 is switched to open the path leading to the inverting channel 208. Meanwhile, the paper ejecting driving roller 2121 is rotated in a reverse direction and cooperates with the paper ejecting follower roller 2122 to feed the paper into the inverting channel 208. After the paper is fed into the inverting channel 208, the paper is successively transported by the third paper transfer roller assembly 111 to the first paper transfer roller assembly 209. Next, the first paper transfer roller assembly 209 transports the paper into the print region 204. At this moment, the image of the second page of the document file has been read and transmitted to the scanning and developing print unit 203. During the paper is transported across the print region 204, developing and printing operations as described for the image of the first page are performed on the second side of the paper. After the toner image is transferred to second side of the paper, the paper with the toner image is transported by the transferring roller 2036 into the paper ejecting channel 207. When the paper is transported across the second paper transfer roller assembly 210, the paper is heated and pressed by the second paper transfer roller assembly 210 so as to facilitate fusing the toner onto the paper. At this moment, the paper guide slice 213 is switched to close the path leading to the inverting channel 208. After the printing operation on the second page of the document file is completed, the paper containing the printed second page is transported to the paper ejecting tray 202 by the paper ejecting roller assembly 212 and thus the duplex printing operation is completed.

In the above embodiment, the duplex printing apparatus of the present invention is distinguished by the inverting channel. The inverting channel is arranged between the print region and the paper ejecting tray. In comparison with the conventional duplex printing apparatus, the inverting channel is much shorter and thus the printing speed is enhanced.

It is noted that, however, those skilled in the art will readily observe that numerous modifications and alterations of the connection member may be made while retaining the teachings of the invention. For example, two papers can be successively printed by the duplex printing apparatus of the present invention during each duplex printing cycle. That is, four pages of the document file can be successively printed out by the duplex printing apparatus of the present invention during each duplex printing cycle. Hereinafter, a procedure of performing a duplex printing operation by the duplex printing apparatus 200 will be also illustrated with reference to FIG. 2. First of all, a first paper is transported from the paper input tray 201 to the print region 204. After the first paper is transported across the print region 204, the image of a first page of the document file is printed on a front side of the first paper. After the printing operation on the front side of the first paper, a second paper is transported from the paper input tray 201 to the print region 204. After the second paper is transported across the print region 204, the image of a third page of the document file is printed on a front side of the second paper. During the front side of the second paper is printed, the first paper is transported into the inverting channel 208. During the second paper is exited from the print region 204 to the paper ejecting roller assembly 212, the first paper is transported to the print region 204 again. After the first paper is transported across the print region 204, the image of a second page of the document file is printed on a rear side of the first paper. During the rear side of the first paper is printed, the second paper is transported into the inverting channel 208. After the duplex printing operation on the first paper is completed and the first paper is exited from the print region 204, the second paper is transported to the print region 204 again and the first paper is transported into the paper ejecting tray 202. After the second paper is transported across the print region 204, the image of a fourth page of the document file is printed on a rear side of the second paper. Next, the duplex printing operation on the second paper is completed and the second paper is transported into the paper ejecting tray 202. Since two papers are successively printed during each duplex printing cycle, the duplex printing apparatus of the present invention has an enhanced printing speed when compared with the conventional duplex printing apparatus. Due to the enhanced printing speed, the printing time is shortened. Moreover, since the inverting channel of the duplex printing apparatus of the present invention is shorted, the number of rollers is reduced and the reliability thereof is increased.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A duplex printing apparatus for printing images on a first side and a second side of a paper, said duplex printing apparatus comprising:

a paper input tray for placing said paper thereon;

a paper ejecting tray disposed above said paper input tray for supporting said printed paper thereon;

a scanning and developing print unit disposed in a print region for reading said images and printing said images on said paper;

a paper feeding channel arranged between said paper input tray and said print region for leading said paper to said print region such that said images are printed on said first side of said paper when said paper is transported across said print region;

a paper pick-up roller disposed beside said paper input tray for transporting said paper into said paper feeding channel;

a paper ejecting channel arranged between said print region and said paper ejecting tray for leading said paper to said paper ejecting tray;

an inverting channel arranged between said print region and said paper ejecting tray for leading said paper to said print region again such that said images are printed on said second side of said paper when said paper is transported across said print region;

a first paper transfer roller assembly arranged at the junction between said paper feeding channel and said inverting channel for transporting said paper into said print region;

a second paper transfer roller assembly disposed in said paper ejecting channel for transporting said paper;

a third paper transfer roller assembly disposed in said inverting channel for transporting said paper to into said print region; and a paper ejecting roller assembly for transporting said paper to either said paper ejecting tray or said inverting channel.

2. The duplex printing apparatus according to claim 1 wherein said scanning and developing print unit includes a laser scanning unit, an optical photoconductive drum, a charging roller, a developer roller, a toner adding roller, a transferring roller and a blade.

3. The duplex printing apparatus according to claim 1 wherein said second paper transfer roller assembly includes a heating roller and a pressing roller.

4. The duplex printing apparatus according to claim 1 wherein said paper ejecting roller assembly comprises:

a paper ejecting driving roller selectively rotated in either a positive direction or a reverse direction to thereby transport said paper to either said paper ejecting tray or said inverting channel; and a paper ejecting follower roller.

5. The duplex printing apparatus according to claim 1 wherein said paper ejecting roller assembly is disposed in said paper ejecting channel.

* * * * *